US008570013B2

(12) United States Patent
Lipcsei et al.

(10) Patent No.: US 8,570,013 B2
(45) Date of Patent: Oct. 29, 2013

(54) POWER REGULATOR FOR CONVERTING AN INPUT VOLTAGE TO AN OUTPUT VOLTAGE

(75) Inventors: Laszlo Lipcsei, Campbell, CA (US); Serban Milhai Popescu, San Carlos, CA (US)

(73) Assignee: O2Micro, Inc., Santa Clara, CA (US)

( * ) Notice: Subject to any disclaimer, the term of this patent is extended or adjusted under 35 U.S.C. 154(b) by 0 days.

(21) Appl. No.: 13/372,395

(22) Filed: Feb. 13, 2012

(65) Prior Publication Data

US 2012/0206120 A1 Aug. 16, 2012

Related U.S. Application Data

(63) Continuation of application No. 12/472,035, filed on May 26, 2009, now Pat. No. 8,143,872.

(60) Provisional application No. 61/131,788, filed on Jun. 12, 2008.

(51) Int. Cl.
*G05F 1/10* (2006.01)

(52) U.S. Cl.
USPC ..... 323/282; 323/274; 323/283

(58) Field of Classification Search
USPC ..... 323/274, 282, 283
See application file for complete search history.

(56) References Cited

U.S. PATENT DOCUMENTS

| | | | |
|---|---|---|---|
| 5,666,044 | A | 9/1997 | Tuozzolo |
| 6,188,212 | B1 | 2/2001 | Larson et al. |
| 6,246,221 | B1 | 6/2001 | Xi |
| 6,278,320 | B1 | 8/2001 | Vu |
| 6,281,667 | B1 | 8/2001 | Matsumura |
| 6,304,131 | B1 | 10/2001 | Huggins et al. |
| 6,465,994 | B1 | 10/2002 | Xi |
| 6,518,737 | B1 | 2/2003 | Stanescu et al. |
| 6,541,946 | B1 | 4/2003 | Chen et al. |
| 6,600,299 | B2 | 7/2003 | Xi |
| 6,847,260 | B2 | 1/2005 | Gupta et al. |

(Continued)

FOREIGN PATENT DOCUMENTS

| | | | |
|---|---|---|---|
| CN | 1287293 | A | 3/2001 |
| JP | H58-179517 | U | 12/1983 |

(Continued)

OTHER PUBLICATIONS

English translation of Office Action for JP2009-140435 dated Jan. 31, 2012 (4 pages).

(Continued)

*Primary Examiner* — Adolf Berhane
*Assistant Examiner* — Yemane Mehari

(57) ABSTRACT

A power regulator for converting an input voltage to an output voltage includes an error amplifier, a start-up circuit, and a pass device. The error amplifier is powered by the output voltage and provides a control current according to a difference between a reference signal and a feedback signal indicative of the output voltage. The start-up circuit is powered by the input voltage and provides a start-up current. The pass device receives the input voltage, provides the output voltage at an output terminal of the power regulator, generates an output current flowing through the output terminal according to the start-up current during a start-up duration of the power regulator, and generates the output current through the output terminal according to the control current during a normal operation of the power regulator.

7 Claims, 4 Drawing Sheets

(56) References Cited

U.S. PATENT DOCUMENTS

| | | | | |
|---|---|---|---|---|
| 6,856,124 | B2 | 2/2005 | Dearn et al. | |
| 6,876,180 | B2 | 4/2005 | Suzuki et al. | |
| 7,218,082 | B2 | 5/2007 | Walter et al. | |
| 7,737,674 | B2 | 6/2010 | Erbito, Jr. | |
| 2012/0206120 | A1* | 8/2012 | Lipcsei et al. | 323/282 |

FOREIGN PATENT DOCUMENTS

| | | | |
|---|---|---|---|
| JP | H05-046263 | A | 2/1993 |
| JP | H05-055207 | U | 7/1993 |
| JP | 2000-353020 | A | 12/2000 |
| JP | 2003-150225 | A | 5/2003 |
| JP | 2005-165716 | A | 6/2005 |
| JP | 2007-140755 | A | 6/2007 |

OTHER PUBLICATIONS

English translation of Japanese OA for JP 2009-140435 dated Oct. 4, 2011.

* cited by examiner

POWER REGULATOR FOR CONVERTING AN INPUT VOLTAGE TO AN OUTPUT VOLTAGE

RELATED APPLICATION

This application is a continuation of the U.S. patent application Ser. No. 12/472,035, entitled "Power Regulator," filed on May 26, 2009, now U.S. Pat. No. 8,143,872, which itself claims priority to U.S. Provisional Application No. 61/131,788, filed on Jun. 12, 2008, both of which are hereby incorporated by reference in their entirety.

BACKGROUND

Some electronic devices or systems, such as cell phones, laptops, camera recorders and other mobile battery operated devices, may include low drop-out (LDO) voltage regulators to provide relatively precise and stable DC voltages. The LDO voltage regulators are configured to provide power to electrical circuits in the electronic devices/systems.

FIG. 1 shows a conventional LDO voltage regulator 100. The LDO voltage regulator 100 can include a pass device 102, an error amplifier 104, a reference voltage circuit 106 and a feedback circuit 108. The LDO voltage regulator 100 can convert an input voltage $V_{IN}$ to an output voltage $V_{OUT}$ at a predetermined level to serve as a power supply. The LDO voltage regulator 100 can further include a compensation circuit 130 to improve stability of the LDO voltage regulator 100.

However, the error amplifier 104 and the reference voltage circuit 106 are driven/powered by the input voltage $V_{IN}$ which may not be stable. Thus, the LDO voltage regulator 100 may have a relatively low power supply rejection ratio (PSRR). The power supply rejection ratio of a regulator is defined as the ratio of the change in supply voltage to the corresponding change in output voltage of the regulator. In addition, the gain of the error amplifier 104 may need to be high enough to compensate characteristic changes of the pass device 102 caused by the input voltage $V_{IN}$ variation.

SUMMARY

In one embodiment, a power regulator for converting an input voltage to an output voltage includes an error amplifier, a start-up circuit, and a pass device. The error amplifier is powered by the output voltage and provides a control current according to a difference between a reference signal and a feedback signal indicative of the output voltage. The start-up circuit is powered by the input voltage and provides a start-up current. The pass device receives the input voltage, provides the output voltage at an output terminal of the power regulator, generates an output current flowing through the output terminal according to the start-up current during a start-up duration of the power regulator, and generates the output current through the output terminal according to the control current during a normal operation of the power regulator.

BRIEF DESCRIPTION OF THE DRAWINGS

Features and advantages of embodiments of the claimed subject matter will become apparent as the following detailed description proceeds, and upon reference to the drawings, wherein like numerals depict like parts, and in which:

DETAILED DESCRIPTION

Reference will now be made in detail to the embodiments of the present invention. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Embodiments in accordance with the present invention provide a power regulator which can have a relatively high power supply rejection ratio (PSRR). Advantageously, an error amplifier in the power regulator and a reference signal circuit for providing a reference signal for the error amplifier can be powered by an output voltage of the power regulator. As a result, some drawbacks caused by the variation of the input voltage of the power regulator can be eliminated and the power regulator can maintain a relatively high power supply rejection ratio.

Figure 1:
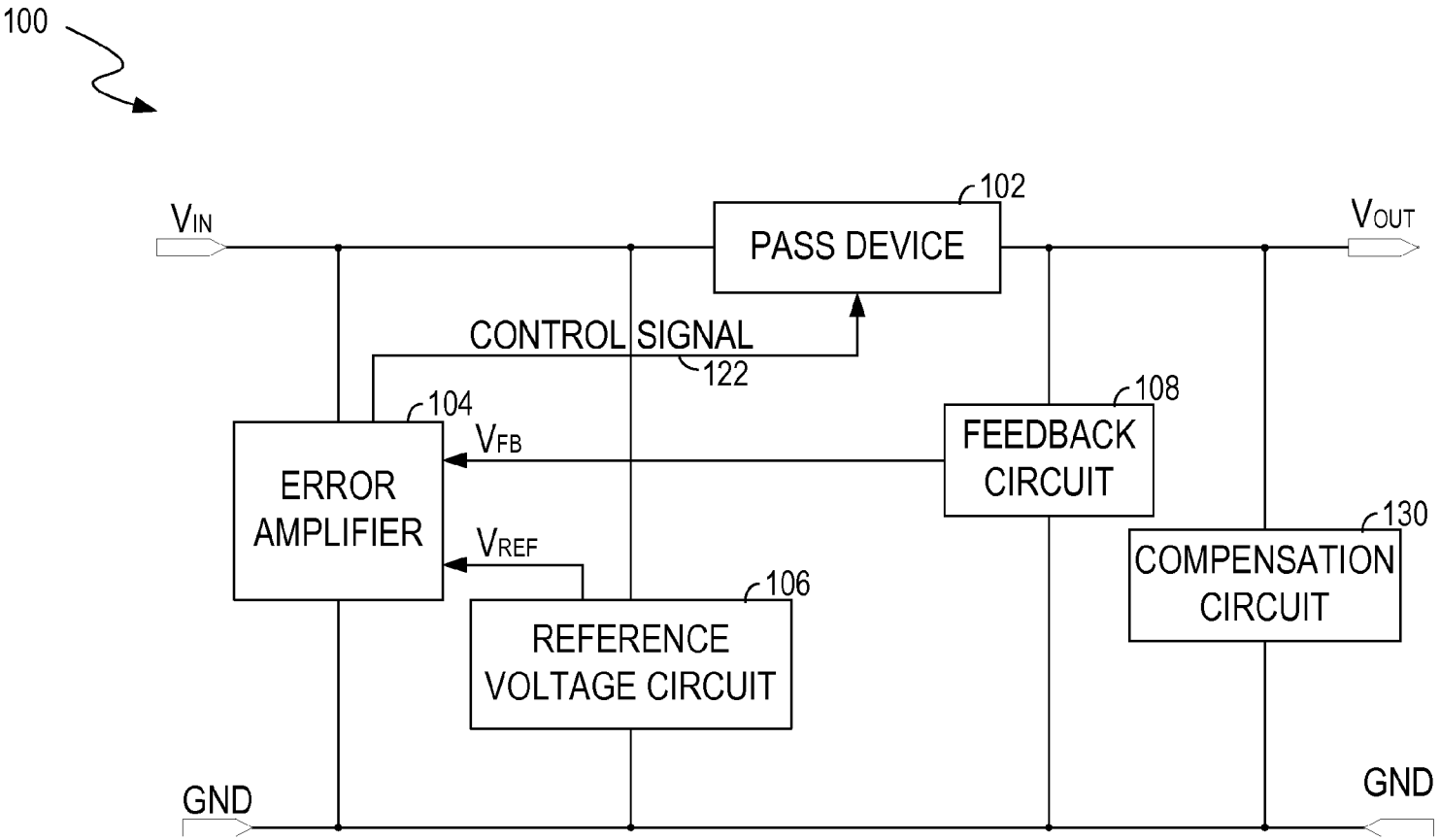
FIG. 1 PRIOR ART
FIG. 1 is a block diagram showing a conventional LDO voltage regulator.
Figure 2:
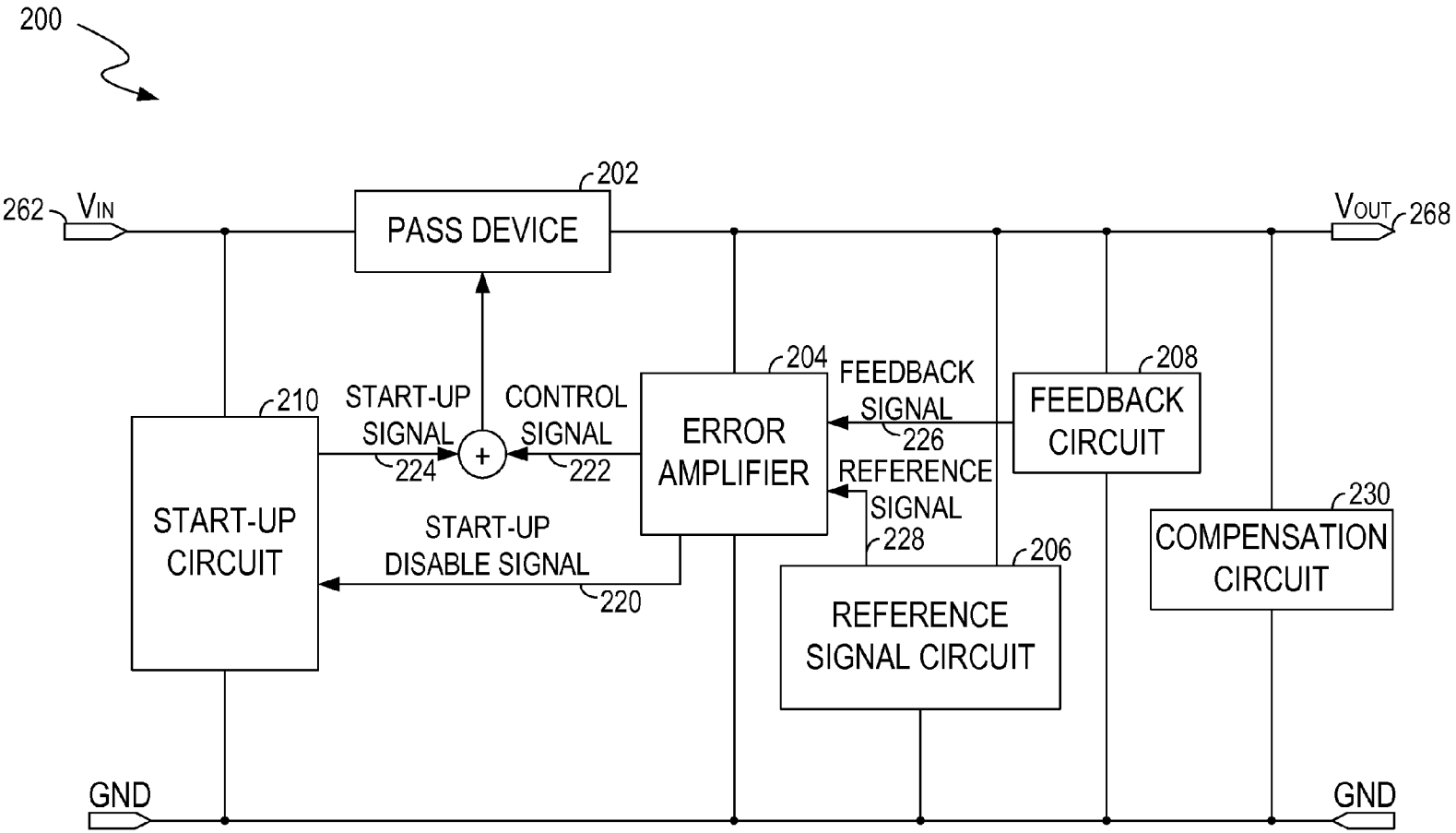
FIG. 2 is a block diagram showing a power regulator according to one embodiment of the present invention.

FIG. 2 shows a power regulator 200 according to one embodiment of the present invention. The power regulator 200, e.g., a low drop-out voltage regulator, can convert an input voltage (or power supply voltage) $V_{IN}$ to an output voltage $V_{OUT}$. In the embodiment of FIG. 2, the power regulator 200 can include a start-up circuit 210, a pass device 202, an error amplifier 204, a reference signal circuit 206, and a feedback circuit 208. The power regulator 200 can further include a compensation circuit 230.

The pass device 202 is coupled to an input terminal 262 of the regulator 200 for receiving the input voltage $V_{IN}$ and providing the output voltage $V_{OUT}$ at an output terminal 268 of the regulator 200. The output voltage $V_{OUT}$ can be used to power the components in the power regulator 200 or an external load (not shown). The pass device 202 is an active device that can be controlled to provide the output voltage $V_{OUT}$. The pass device 202 can include power transistors. In one embodiment, the pass device 202 can be selectively controlled by a start-up signal 224 from the start-up circuit 210 or a control signal 222 from the error amplifier 204. More specifically, the pass device 202 can be controlled by the start-up signal 224 during a start-up duration of the regulator 200 and can be controlled by the control signal 222 during a normal operation of the regulator 200.

The feedback circuit 208 is coupled to the output terminal 268 for generating a feedback signal 226 indicative of the output voltage $V_{OUT}$. The reference signal circuit 206 coupled to the output terminal 268 is powered by the output voltage $V_{OUT}$ to provide a reference signal 228. Alternatively, the reference signal 228 can be provided by an external device. The error amplifier 204 coupled to the pass device 202 is powered by the output voltage $V_{OUT}$ to compare the reference signal 228 with the feedback signal 226, and to generate a control signal 222 according to a result of the comparison to drive the pass device 202. The feedback circuit 208, the error amplifier 204 and the pass device 202 together are formed as a negative feedback loop to produce a relatively precise and stable output voltage $V_{OUT}$ at the output terminal 268.

The compensation circuit 230 can be used to compensate the output voltage $V_{OUT}$ variation. The output voltage $V_{OUT}$ variation can be caused by the characteristic changes of the pass device 202, which is due to the variations of the input voltage $V_{IN}$.

Advantageously, the error amplifier 204 and the reference signal circuit 206 can be powered by the output voltage $V_{OUT}$. The output voltage $V_{OUT}$ can be properly generated when the pass device 202 operates properly. Advantageously, the start-up circuit 210 can be used to drive the pass device 202 during a start-up duration of the regulator 200. In one embodiment, the start-up circuit 210 is enabled during the start-up duration of the regulator 200. The start-up circuit 210 coupled to the pass device 202 is powered by the input voltage $V_{IN}$ to generate a start-up signal 224, in one embodiment. The start-up signal 224 can drive the pass device 202 to generate the output voltage $V_{OUT}$. When the output voltage $V_{OUT}$ reaches a certain level which is able to enable the error amplifier 204 and the reference signal circuit 206, the regulator 200 can operate in the normal mode.

Once the regulator 200 operates in the normal mode, a start-up disable signal 220 can be sent to the start-up circuit 210 to disable the start-up circuit 210. In one embodiment, the error amplifier 204 can provide the start-up disable signal 220 to disable the start-up circuit 210. In another embodiment, the start-up disable signal 220 can be provided by the reference signal circuit 206. During the normal operation of the regulator 200, the error amplifier 204 can amplify a difference between the reference signal 228 and the feedback signal 226 and generate the control signal 222 to drive the pass device 202, in one embodiment.

As such, the start-up circuit 210 can be enabled when the output voltage $V_{OUT}$ that powers the error amplifier 204 or the reference signal circuit 206 is less than a predetermined threshold, e.g., during start-up or under-voltage conditions. The start-up circuit 210 can be disabled if the error amplifier 204 and the reference signal circuit 206 operate properly, e.g., when the output voltage $V_{OUT}$ is greater than the predetermined threshold.

Advantageously, the error amplifier 204 and the reference signal circuit 206 are powered by the output voltage $V_{OUT}$ which can be relatively stable. As a result, the error amplifier 204 and the reference signal circuit 206 can operate properly even if the input voltage $V_{IN}$ varies, in one embodiment. Therefore, the regulator 200 can have an improved power supply rejection ratio.

Figure 3:
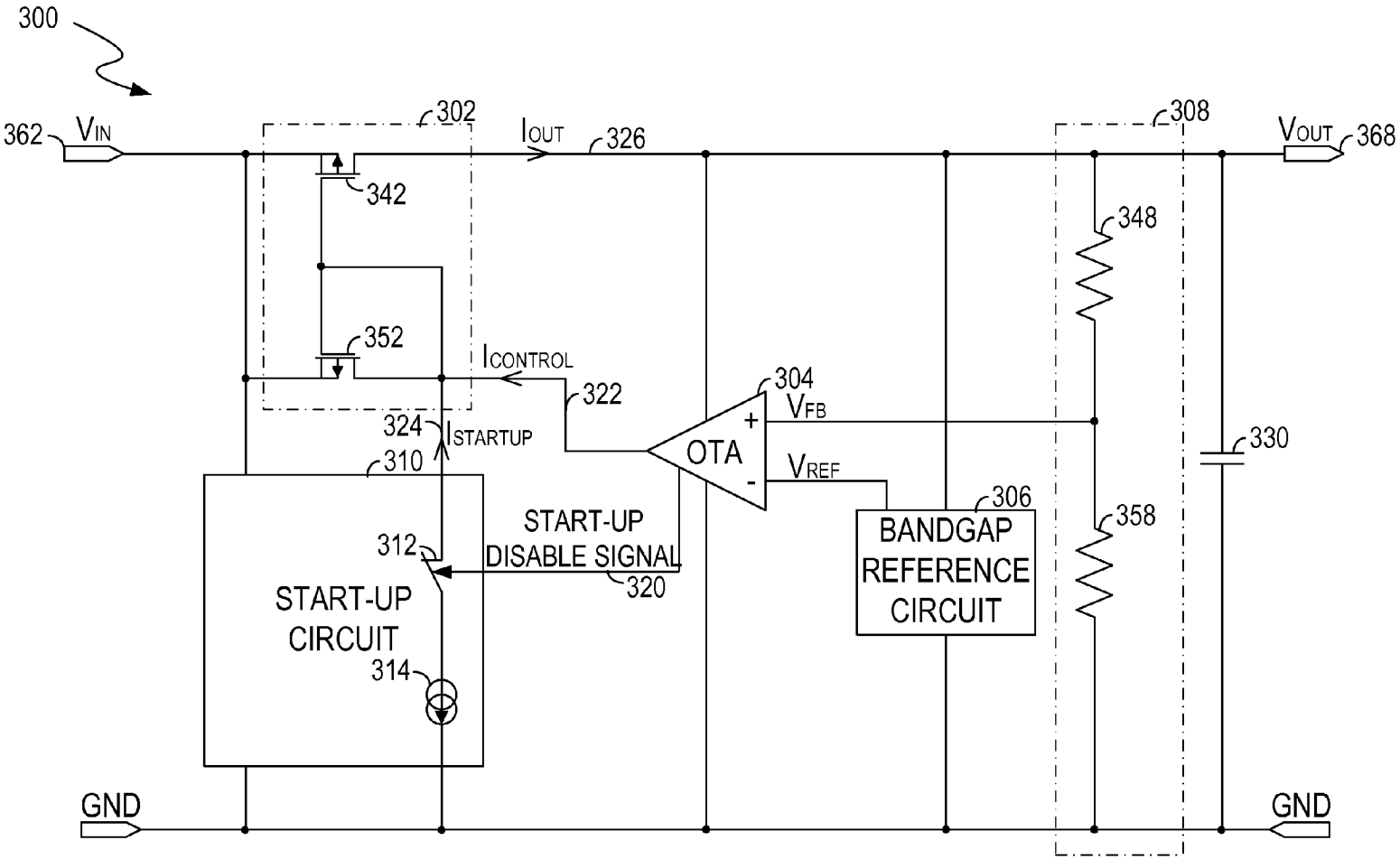
FIG. 3 is a detailed block diagram showing a power regulator according to one embodiment of the present invention.

FIG. 3 shows a power regulator 300 according to one embodiment of the present invention. In the embodiment of FIG. 3, the power regulator 300 can include a pass device 302, a start-up circuit 310, an operational transconductance amplifier (OTA) 304, a bandgap reference circuit 306, a feedback circuit 308, and a capacitor 330.

An input voltage $V_{IN}$ is supplied to the start-up circuit 310 and the pass device 302 at an input terminal 362 of the power regulator 300. An output voltage $V_{OUT}$ and an output current $I_{OUT}$ is provided by the pass device 302 at an output terminal 368 of the power regulator 300. The OTA 304 and the bandgap reference circuit 306 are powered by the output voltage $V_{OUT}$. The capacitor 330 coupled to the output terminal 368 can serve as a compensation circuit and filter the output voltage $V_{OUT}$, thus improving the stability of the power regulator 300, in one embodiment.

In the embodiment of FIG. 3, the start-up circuit 310 can include a switch 312 and a current generator 314 coupled in series. During the start-up duration (e.g., when the $V_{OUT}$ is less than a predetermined threshold), the switch 312 is turned on to allow a start-up current $I_{STARTUP}$ 324 generated by the current generator 314 to drive the pass device 302. During the normal operation of the regulator 300 (e.g., when the $V_{OUT}$ is greater than the predetermined threshold), the switch 312 is turned off to disable the start-up circuit 310.

The feedback circuit 308 can include a resistor 348 and a resistor 358 coupled in series between the output terminal 368 and ground. A feedback voltage $V_{FB}$ which is proportional to the output voltage $V_{OUT}$ is generated at a node between the resistors 348 and 358. The feedback voltage $V_{FB}$ is received by the OTA 304, in one embodiment. A reference voltage $V_{REF}$ can be provided by the bandgap reference circuit 306 and is received by the OTA 304, in one embodiment. The OTA 304 can generate a control current $I_{CONTROL}$ 322 to drive the pass device 302 based on a voltage difference between the reference voltage $V_{REF}$ and the feedback voltage $V_{FB}$.

The pass device 302 coupled to the input terminal 362 can be a current mirror formed by a PMOS 342 and a PMOS 352. In one embodiment, the pass device 302 can generate the output current $I_{OUT}$ 326 at the output terminal 368 based on the start-up current $I_{STARTUP}$ 324 from the current generator 314 or the control current $I_{CONTROL}$ 322 from the OTA 304. The mirroring ratio of the current mirror can be predetermined.

In operation, when the power regulator 300 is initially powered on, the switch 312 in the start-up circuit 310 is turned on. Thus, the pass device 302 receives the start-up current $I_{STARTUP}$ 324 to generate the output current $I_{OUT}$ 326. The output current $I_{OUT}$ 326 at the output terminal 368 is $K*I_{STARTUP}$, where the mirroring ratio of the current mirror is K. By charging the capacitor 330 with the output current $I_{OUT}$ 326, the output voltage $V_{OUT}$ at the output terminal 368 can rise to a level which is able to enable the OTA 304 and the bandgap reference circuit 306. Thus, the OTA 304 and the bandgap reference circuit 306 can operate properly.

Once the OTA 304 and the bandgap reference circuit 306 can operate properly, a start-up disable signal 320 can be generated to turn off the switch 312, thus disabling the start-up circuit 310, in one embodiment. Advantageously, the start-up circuit 310 can enable the OTA 304 and the bandgap reference circuit 306 during the start-up duration and will be disabled when the OTA 304 and the bandgap reference circuit 306 operate properly, in one embodiment.

The OTA 304 can amplify a voltage difference between the reference voltage $V_{REF}$ and the feedback voltage $V_{FB}$, and generate the control current $I_{CONTROL}$ 322 to drive the pass device 302, in one embodiment. The output current $I_{OUT}$ 326 generated by the current mirror is $K*I_{CONTROL}$, in one embodiment. The feedback circuit 308, the OTA 304 and the pass device 302 are formed as a negative feedback loop to control the output voltage $V_{OUT}$ at a predetermined level.

In one embodiment, the control current $I_{CONTROL}$ 322 and the start-up current $I_{STARTUP}$ 324 can be limited to a maximum value $I_{MAX}$. Thus, the output current $I_{OUT}$ 326 can be limited to $K*I_{MAX}$.

Figure 4:
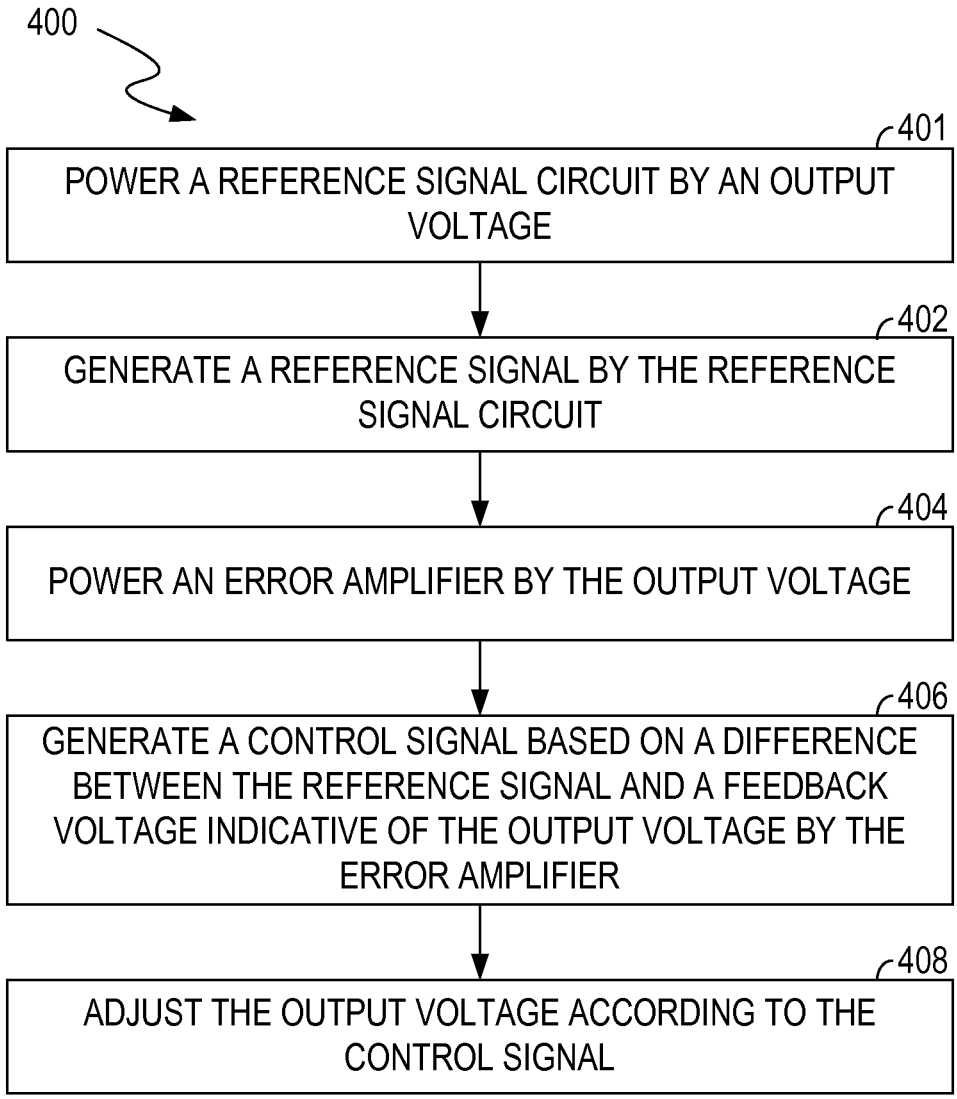
FIG. 4 is a flowchart showing a method for converting an input voltage to an output voltage according to one embodiment of the present invention.

FIG. 4 shows a flowchart of a method for converting an input voltage to an output voltage according to one embodiment of the present invention. FIG. 4 is described in combination with FIG. 2.

In block 401, the reference signal circuit 206 is powered by the output voltage $V_{OUT}$. In one embodiment, during the start-up duration, the start-up circuit 210 powered by the input voltage $V_{IN}$ can be enabled to generate the start-up signal 224 to control the output voltage $V_{OUT}$.

In block 402, the reference signal 228 is generated by the reference signal circuit 206. In block 404, the error amplifier 204 is powered by the output voltage $V_{OUT}$. In block 406, the control signal 222 is generated based on a difference between the reference signal 228 and the feedback signal 226 indicative of the output voltage $V_{OUT}$ by the error amplifier 204.

In block 408, the output voltage $V_{OUT}$ is adjusted according to the control signal 222. In one embodiment, the control signal 222 can drive the pass device 202 to adjust the output voltage $V_{OUT}$. In one embodiment, the pass device 202 can be selectively controlled by the control signal 222 and the start-up signal 224.

While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A power regulator comprising:

an error amplifier, powered by an output voltage, that receives a reference signal and a feedback signal indicative of said output voltage, and that provides a control current according to a difference between said reference signal and said feedback signal;

a start-up circuit, powered by an input voltage, that provides a start-up current; and a pass device, coupled to said error amplifier and said start-up circuit, that receives said input voltage, provides said output voltage at an output terminal of said power regulator, generates an output current flowing through said output terminal according to said start-up current during a start-up duration of said power regulator, and generates said output current through said output terminal according to said control current during normal operation of said power regulator subsequent to said start-up duration, wherein during said normal operation, said output current increases if said control current increases, and said output current decreases if said control current decreases, wherein said pass device comprises a current mirror that mirrors said start-up current to said output current at a first predetermined ratio during said start-up duration, and wherein said first predetermined ratio is determined by a first mirroring ratio of said current mirror.

2. The power regulator of claim 1, further comprising:

a reference circuit, powered by said output voltage, that provides said reference signal.

3. The power regulator of claim 1, wherein said start-up circuit comprises a current generator and a switch coupled in series, and wherein said switch is turned on during said start-up duration and is turned off during said normal operation.

4. The power regulator of claim 3, wherein said switch is turned on if said output voltage is less than a predetermined threshold, and is turned off if said output voltage is greater than said predetermined threshold.

5. The power regulator of claim 1, wherein said current mirror mirrors said start-up current to said output current during said start-up duration and mirrors said control current to said output current during said normal operation of said power regulator.

6. The power regulator of claim 1, wherein during said start-up duration, said output current increases if said start-up current increases, and said output current decreases if said start-up current decreases.

7. The power regulator of claim 1, wherein said current mirror mirrors said control current to said output current at a second predetermined ratio during said normal operation, and wherein said second predetermined ratio is determined by a second mirroring ratio of said current mirror.

* * * * *